US006726078B2

(12) United States Patent
Flannery

(10) Patent No.: US 6,726,078 B2
(45) Date of Patent: Apr. 27, 2004

(54) SYSTEM FOR DISPENSING PLASTIC FASTENERS

(75) Inventor: Steven E. Flannery, Wayland, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/898,761

(22) Filed: Jul. 3, 2001

(65) Prior Publication Data

US 2003/0006264 A1 Jan. 9, 2003

(51) Int. Cl.[7] ..... A43D 69/00
(52) U.S. Cl. ..... 227/67; 227/76
(58) Field of Search ..... 227/67, 76, 114, 227/71, 152, 154; 29/811.2; 112/80

(56) References Cited

U.S. PATENT DOCUMENTS 339,642 A * 4/1886 Griffin ..... 112/80.05
889,922 A * 6/1908 Garrett ..... 112/80.05
2,828,881 A * 4/1958 Lindly ..... 227/55
3,735,908 A * 5/1973 Kinney et al. ..... 227/124
4,039,078 A 8/1977 Bone
4,267,784 A * 5/1981 Heemstra ..... 112/80.04
4,315,587 A * 2/1982 Ritter et al. ..... 227/124
4,711,369 A * 12/1987 Duchin ..... 221/213
4,877,172 A * 10/1989 Franklin et al. ..... 227/114
5,433,366 A * 7/1995 Deschenes et al. ..... 227/67
5,456,194 A * 10/1995 Badillo ..... 112/470.14
5,471,727 A * 12/1995 Kubota ..... 227/67
5,615,816 A 4/1997 Deschenes et al.
5,950,901 A * 9/1999 Kubota ..... 227/67
6,244,490 B1 * 6/2001 Flannery et al. ..... 227/140

* cited by examiner

*Primary Examiner*—Rinaldi I. Rada
*Assistant Examiner*—Louis Tran
(74) *Attorney, Agent, or Firm*—Kriegsman & Kriegsman

(57) ABSTRACT

A system for dispensing a fastener from a reel of fastener stock so as to couple together two or more objects includes a frame, a needle, a feed mechanism for advancing the fastener into the needle, a severing mechanism for severing the fastener from the fastener stock, an ejection mechanism for ejecting the fastener through the needle, and a needle guard assembly mounted onto the frame. The needle guard assembly includes a guide plate having a front surface and a bracket assembly affixed to the guide plate. The bracket assembly is slidably mounted onto the frame to enable the guide plate to be slidably disposed between a protected position in which the tip of the needle is positioned behind the front surface of the guide plate and a fully retracted position in which the tip of the needle is positioned in front of the front surface of the guide plate.

8 Claims, 10 Drawing Sheets

SYSTEM FOR DISPENSING PLASTIC FASTENERS

BACKGROUND OF THE INVENTION

The present invention relates generally to plastic fasteners and more particularly to devices used in the dispensing of plastic fasteners.

In U.S. Pat. No. 4,039,078 to A. R. Bone, which is incorporated herein by reference, there are disclosed several different types of plastic fasteners, or attachments, which are fabricated as part of continuously connected ladder stock. In each instance, the fastener has an H-shape, and the ladder stock is formed from two elongated and continuous plastic side members coupled together by a plurality of plastic cross links, the cross links preferably being equidistantly spaced. The stock may be produced from flexible plastics material including nylon, polypropylene and other similar materials by molding or by stamping.

Either manually or with the aid of specifically designed devices, individual fasteners may be dispensed from a supply of ladder stock to couple buttons to fabric, merchandising tags to articles of commerce, or, in general, any two desired articles.

Specifically designed devices for dispensing plastic fasteners are well known in the art. In use, plastic fastener dispensing devices sever individual plastic fasteners from continuously connected ladder stock and attach the severed individual plastic fasteners to the items to be coupled.

For example, in commonly assigned U.S. Pat. No. 5,433,366, which is incorporated herein by reference, there is disclosed a device for dispensing plastic attachments of the type which are formed as part of a roll of continuously connected ladder stock. In one embodiment, the device includes a pair of hollow slotted needles each having a tip, a rear end and a longitudinal axis. A feed wheel, placed proximate to the rear ends of the pair of needles, is used to feed individual attachments of a roll of ladder stock into the pair of needles through their respective rear ends at angles relative to the longitudinal axes thereof. Once inserted into the needles, an attachment is severed from the remainder of the ladder stock by a knife and is then expelled from the needles by a pair of ejector rods movable along the longitudinal axes of the pair of needles. Because attachments are fed into the pair of needles at angles relative to their longitudinal axes, no shuttling of the needles between an attachment feeding position and an attachment ejecting position is required. The pair of needles, the feed wheel, the knife, and the pair of ejector rods are all mounted on a vertically movable head member. An electric motor assembly is used to move the head member between an attachment dispensing position and a withdrawal position. The vertical movement of the head member drives the operation of the feed wheel, the knife and the ejector rods.

In one type of plastic fastener dispensing device which is well known in the art, the plastic fastener dispensing device is mounted directly onto a flat work surface, such as a table, and the operator is required to manually urge the items to be coupled together against the sharpened tip of each hollow slotted needle until each needle penetrates through the items. Once each needle has penetrated through the items, the device is activated. Activation of the device dispenses a plastic fastener through each needle so as to secure the items together. As can be appreciated, such plastic fastener dispensing devices are commonly used in the art to couple together two or more items, such as socks, gloves, towels or the like. Furthermore, it should be noted that, when used to secure together two or more items for sale, plastic fasteners are commonly referred to as elastic staples in the art.

It should be noted that the use of a plastic fastener dispensing device of the type described above to tightly secure together two or more items for sale using one or more elastic staples provides numerous advantages.

As a first advantage, plastic fastener dispensing devices of the type described above are capable of continuously dispensing elastic staples from a roll of fastener stock. As a result, the continuous feed of elastic staples into the plastic fastener dispensing device increases the productivity in which an operator is able to secure together products for sale, which is highly desirable. It is for this reason that plastic fastener dispensing devices of the type described above are commonly used on assembly lines for packaging products.

As a second advantage, the use of elastic staples to secure together two or more items for sale creates aesthetic benefits, which is highly desirable. Specifically, the use of elastic staples enables the products for sale to be neatly and securely fastener together in an ideal packaging to enable a potential customer to see, feel and manipulate the product at the point of purchase. Furthermore, it has been found that the elastic staple is barely visible when securing together two or more products for sale.

As a third advantage, the elasticity of the staple allows for the fastener to be used in a wide range of applications and in conjunction with a variety of differently sized products, which is highly desirable.

As a fourth advantage, the elasticity of the staple allows for the fastener to conform tightly against the products for sale, thereby creating a strong and durable attachment of the products, which is highly desirable. As a result, the products remain securely fastened together until after purchase.

Although well known and widely used in the art for securing together products for sale, plastic fastener dispensing devices which require an operator to urge the products against the one or more hollowed needles suffer from a couple notable drawbacks.

As a first drawback, plastic fastener dispensing devices which require an operator to urge the products against one or more hollowed needles fail to adequately protect the operator from inadvertently contacting the sharpened tip of each needle, which is highly undesirable.

As a second drawback, plastic fastener dispensing devices which require an operator to urge the products against one or more hollowed needles fail to adequately support, or stiffen, each needle. As a result, each needle is susceptible to bending and breaking when inserted through the items to be coupled, which is highly undesirable.

SUMMARY OF THE INVENTION

It is an object of the present invention to provide a new and improved system for dispensing a plastic fastener from a reel of fastener stock to couple together two or more items.

It is another object of the present invention to provide a system as described above which includes a hollowed needle having a sharpened tip, the needle enabling the plastic fastener to pass through the items to be coupled together.

It is yet another object of the present invention to provide a system as described above which protects the operator from inadvertently contacting the sharpened tip of the hollowed needle.

It is still another object of the present invention to provide a system as described above which adequately supports, or stiffens, the hollowed needle.

It is yet still another object of the present invention to provide a system as described above which has a limited number of parts, which is easy to use and which is inexpensive to manufacture.

Accordingly, there is provided a system for dispensing a plastic fastener from a reel of fastener stock to couple together two or more objects, said system comprising a frame, a hollowed needle having a sharpened tip, a feed mechanism for advancing the fastener stock into said hollowed needle, a severing mechanism for severing the fastener to be dispensed through said hollowed needle from the fastener stock, an ejection mechanism for ejecting the severed fastener through said hollowed needle, and a needle guard slidably mounted onto said frame over said hollowed needle.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
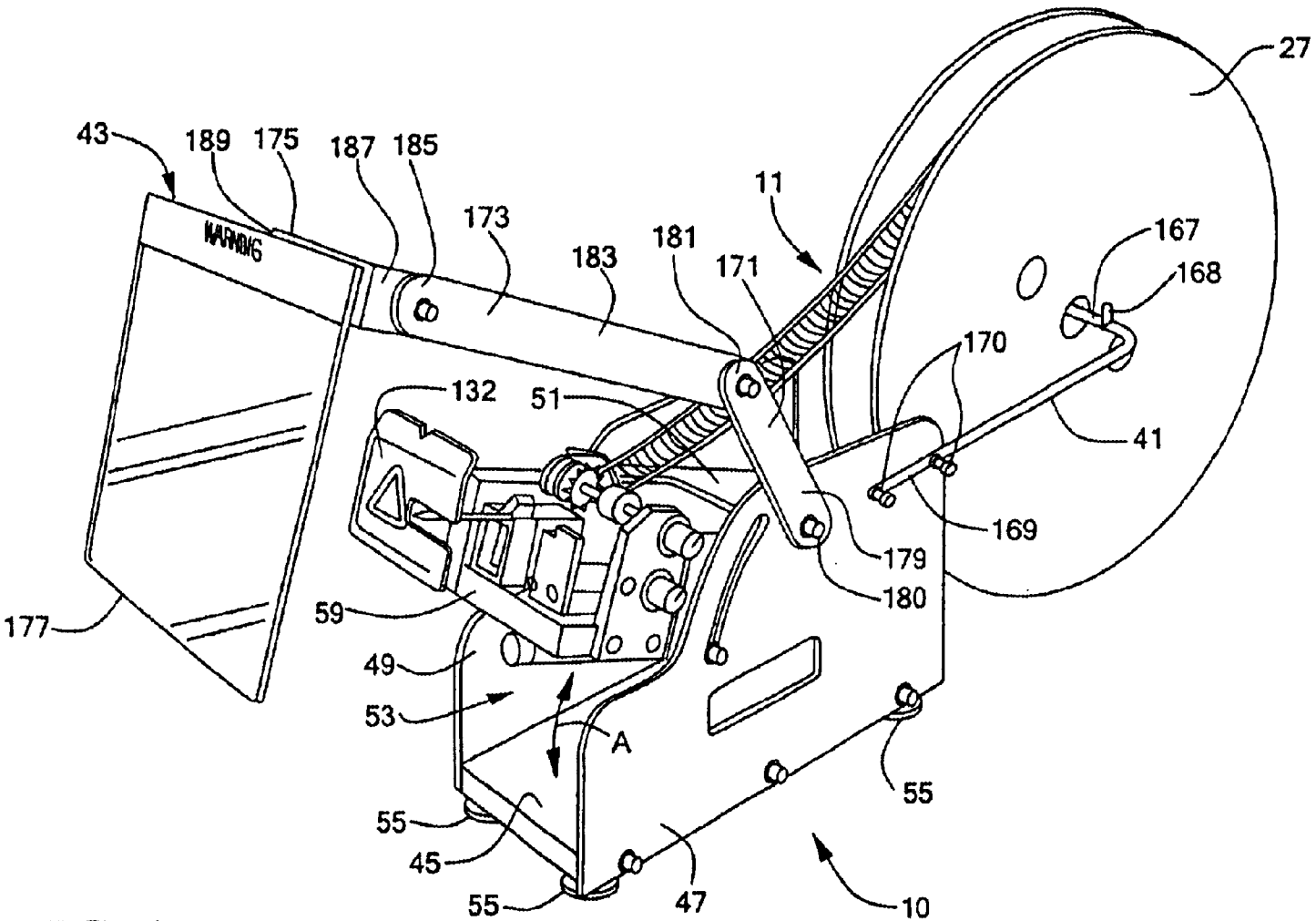
FIG. 1 is a right side perspective view of a system constructed according to the teachings of the present invention for dispensing plastic fasteners, the system being shown with a supply of continuously connected ladder stock fed therein.
Figure 2:
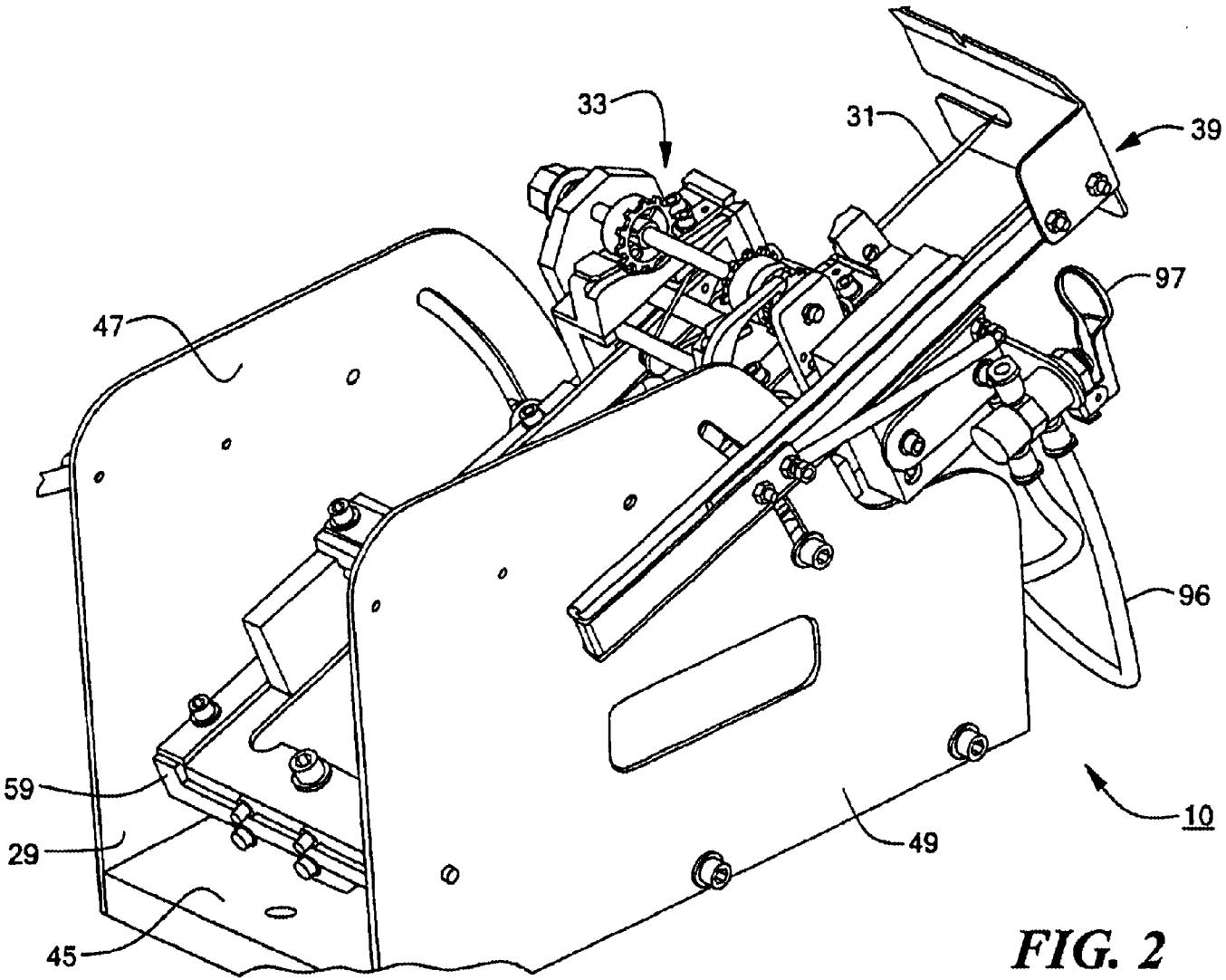
FIG. 2 is a left side, fragmentary, perspective view of the system shown in FIG. 1.

Referring now to FIGS. 1–4, there is shown a single needle system (SNS) constructed according to the teachings of the present invention, the system being identified generally by reference numeral 10. As will be described further in detail below, system 10 is designed for use in dispensing plastic fasteners from a supply of continuously connected ladder stock 11.

As such, system 10 can be used in an automated packaging line. Specifically, system 10 may be used, for example, to secure together two or more products P, such as socks, gloves, towels or other similar items, using one or more plastic fasteners.

Continuous Supply of Ladder Stock 11

Figure 7:
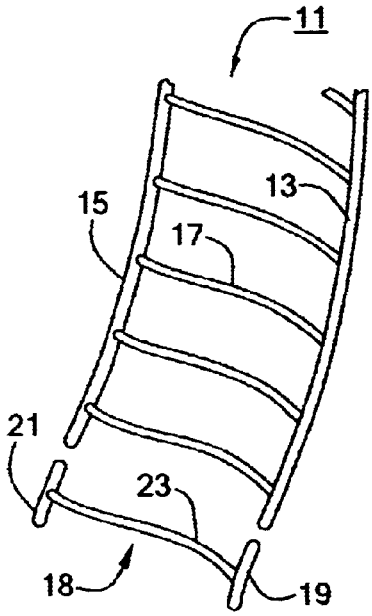
FIG. 7 PRIOR ART
FIG. 7 is an enlarged, fragmentary, perspective view of the supply of the continuously connected ladder stock shown in FIG. 1.
Figure 8:
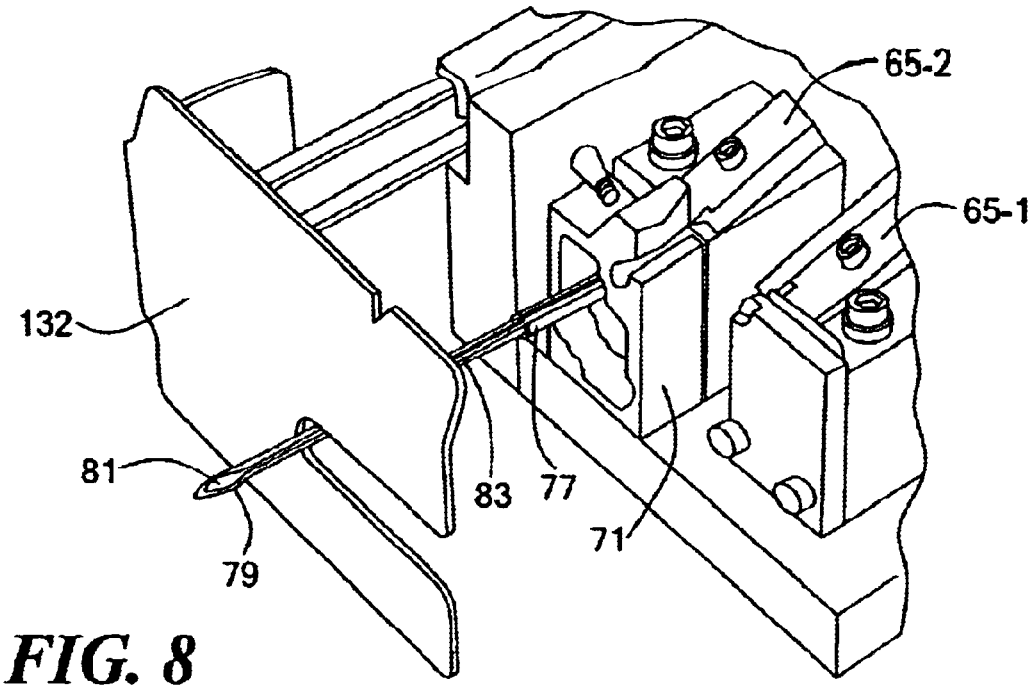
FIG. 8 is a fragmentary, exploded perspective view of the system shown in FIG. 1.

Continuous supply of connected ladder stock 11 represents any well known continuous supply of plastic fasteners. For example, ladder stock 11 may be of the type described in U.S. Pat. No. 5,615,816 to Charles L. Deschenes et al. Specifically, FIG. 7 shows a prior art length of continuously connected ladder stock 11 with which the system of this invention may be used. Ladder stock 11 is preferably made of plastic and comprises a pair of side members 13 and 15 interconnected by a plurality of cross links 17. A fastener 18 which is obtained from ladder stock 11 is commonly referred to as an elastic staple in the art. Fastener 18 comprises a pair of end bars 19 and 21 which are interconnected by a filament 23, end bars 19 and 21 comprising sections of side members 13 and 15, respectively, and filament 23 comprising a cross link 17.

Although system 10 is shown with ladder stock 11, it is to be understood that system 10 could be used with alternative types of ladder stock without departing from the spirit of the present invention.

It should be noted that ladder stock 11 is preferably wound onto a reel 27, reel 27 being sized and shaped to hold a supply of ladder stock 11 which includes approximately 10,000 fasteners 18. As such, the high volume reel 27 of fasteners 18 enables for continuous operation of system 10.

System 10 for Dispensing Plastic Fasteners 18

System 10 comprises a frame 29, a hollowed needle 31, a feed mechanism 33 for advancing individual plastic fasteners 18 into hollowed needle 31, a severing mechanism 35 for severing an individual fastener 18 to be dispensed through needle 31 from the remainder of supply of fastener stock 11, an ejection mechanism 37 for ejecting the individual fastener 18 through needle 31, a needle guard assembly 39 mounted onto frame 29 over hollowed needle 31, a reel holder 41 affixed to frame 29 for supporting reel 27 of fastener stock 11, and an eye shield assembly 43 affixed to frame 29 for protecting the eyes of the operator during use of system 10. It should be noted that portions of system 10 not pertinent to this invention are neither shown nor described in detail herein.

Frame 29 for System 10

Frame 29 comprises a base plate 45 which is constructed of a rigid and durable material and which serves as the support, or foundation, for frame 29. A first side panel 47 constructed of a rigid and durable material is affixed to base plate 45, such as by screws. Similarly, a second side panel 49 constructed of a rigid and durable material is affixed to base plate 45, such as by screws. It should be noted that first and second side panels 47 and 49 are spaced apart in a parallel relationship. A top panel 51 constructed of a rigid and durable material is affixed to and extends perpendicularly between first and second side panels 47 and 49, top panel 51 being spaced apart from base plate 45. Together, base plate 45, first side panel 47, second side panel 49 and top panel 51 define an internal cavity 53.

Frame 29 also preferably comprises a plurality of feet 55 which are mounted onto base plate 45. As can be appreciated, feet 55 enable system 10 to be mounted directly on top of a working surface, such as a table. It should be noted that each foot 55 may be in the form of a suction cup so as to securely retain system 10 in a fixed position on the working surface.

Needle 31 for System 10

Needle 31 for system 10 serves as a conduit through which an individual fastener 18 is able to penetrate through the products P to be coupled, as will be described further below. It should be noted that although system 10 is shown comprising a single needle 31, system 10 could alternatively comprise a pair of needles 31 for product stapling applications without departing from the spirit of the present invention.

System 10 comprises a frame 59 which is disposed within internal cavity 53 between first and second side panels 47 and 49, frame 59 being capable of being pivoted towards and away from base plate 45, as represented by arrow A in FIG. 1.

First and second spaced apart support plates 61-1 and 61-2 are affixed onto frame 59 with screws 63. A pair of needle blocks 65-1 and 65-2 are mounted on a shaft 67 which extends laterally between first and second support plates 61-1 and 61-2. A manually rotatable needle adjustment knob 69 is fixedly mounted onto one end of shaft 67. As can be appreciated, rotation of knob 69 laterally displaces needle block 65-1. A needle holder 71 is fixedly mounted onto needle block 65-2 by screws 73.

Hollow needle 31 is mounted onto needle holder 71. Needle 31 represents a conventional hollow slotted fastener dispensing needle and includes a first end 77, a second end 79, an elongated channel 81 and an elongated slot 83 in communication with elongated channel 81. First end 77 of needle 31 is sized and shaped to be fittingly disposed within a needle receptacle 78 formed in needle holder 71, thereby enabling needle 31 to project perpendicularly out from needle holder 71. Second end 79 of needle 31 is in the form of a spoon-shaped sharpened tip through which an end bar of fastener 18 may pass during the dispensing process.

Ejection Mechanism 37 for System 10

Figure 13:
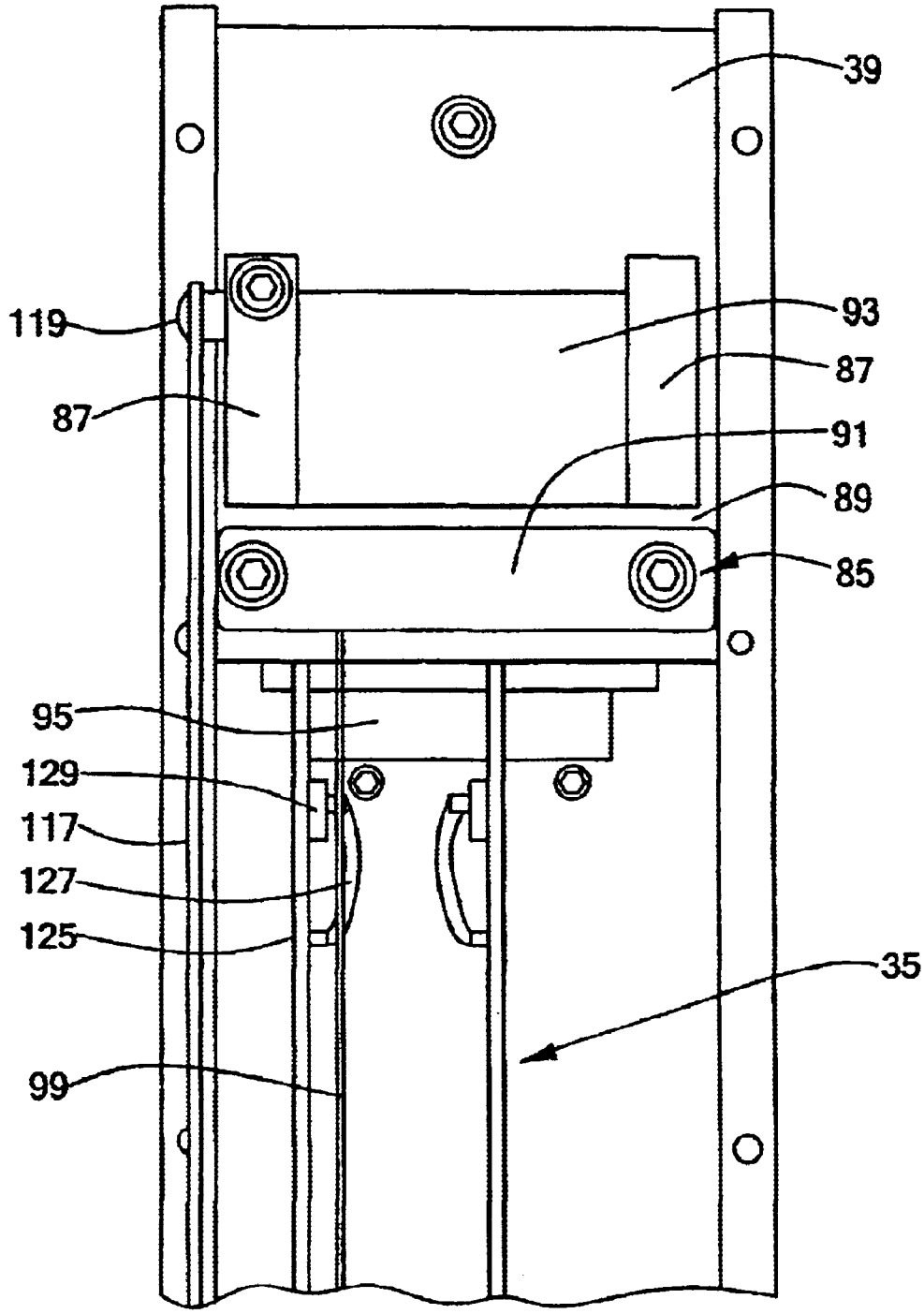
FIG. 13 is a fragmentary, top plan view of selected components of the system shown in FIG. 1.

As noted above, system 10 also comprises an ejection mechanism 37 for dispensing a fastener 18 out through needle 31. As shown in FIG. 13, ejection mechanism 37 includes an ejector rod slide 85 which is adapted to slide vertically along frame 59, ejector rod slide 85 comprising a pair of spaced apart sidewalls 87, a top wall 89 affixed to sidewalls 87, a plate 91 affixed to top wall 89, a bottom wall 93 affixed to sidewalls 87 and a ramp 95 formed onto bottom wall 93. Ejector rod slide 85 is powered for vertical displacement by an pneumatic system 96 which operates on 80 psi. Application of air pressure from pneumatic system 96 is achieved through the depression of a spoon-shaped actuation lever 97 mounted on second side panel 49.

Ejection mechanism 37 also includes an ejector rod 99 which is disposed within a slot 101 formed into top wall 89 and are retained therein through the mounting of plate 91 onto top wall 89. Ejector rod 99 is positioned to extend down through needle block 65-2. Accordingly, as ejector rod slide 85 travels downward, ejector rod 99 projects into channel 81 of needle 75 so as to dispense fastener 18 out from system 10.

As can be appreciated, ejector rod slide 85 is adapted to slide vertically along frame 59. As such, slide 85 is capable of a downward stroke in which ejector rod 99 projects into channel 81 of needle 31 and an upward stroke in which ejector rod 99 retracts from needle 31.

It should be noted that the construction and functionality of ejection mechanism 37 does not serve as a principal feature of the present invention. As a result, it is to be understood that ejection mechanism 37 could be of the type disclosed in U.S. Pat. No. 5,433,366 to Charles L. Deschenes et al. without departing from the spirit of the present invention.

Feed Mechanism 33 for System 10

Figure 11:
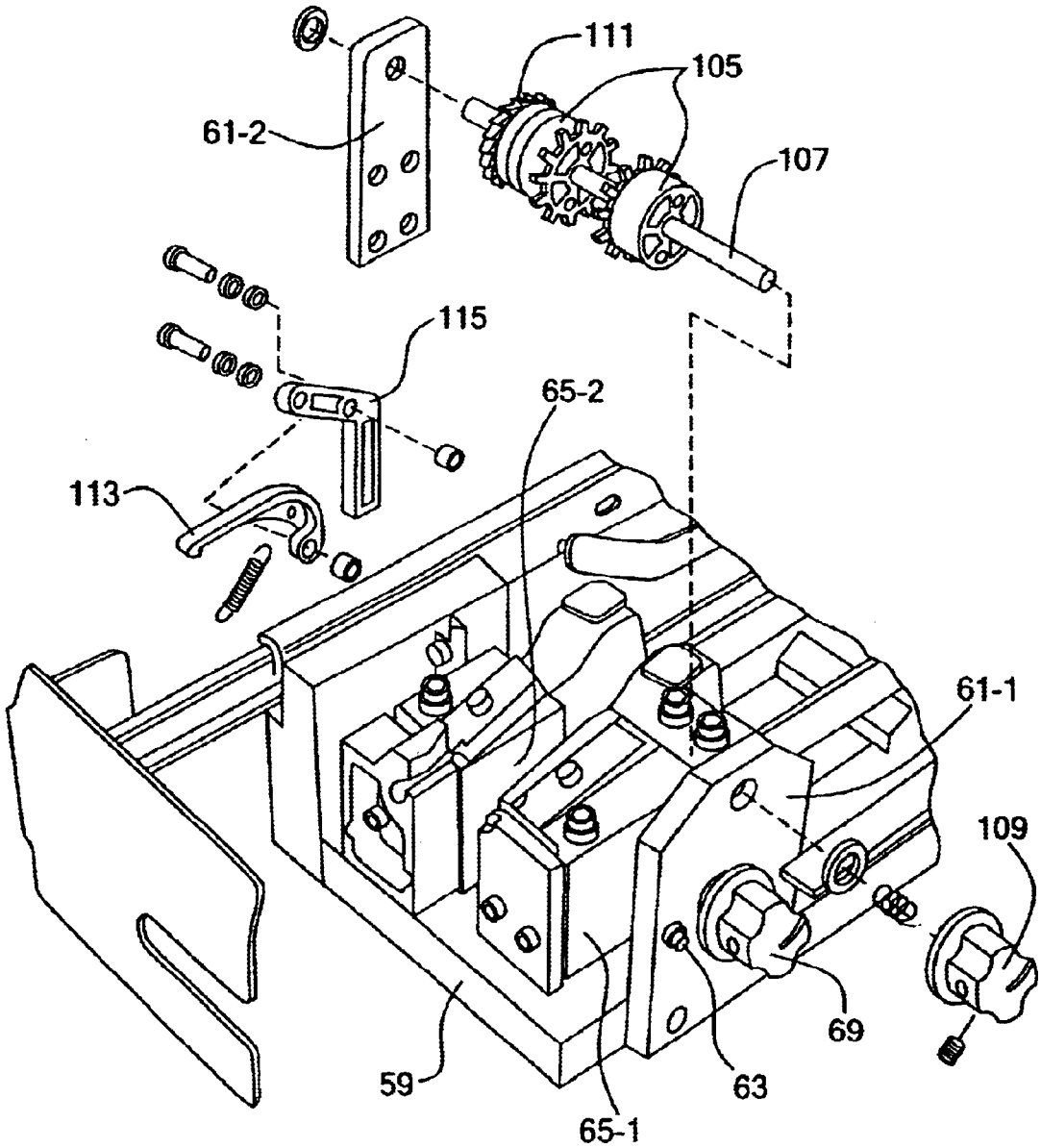
FIG. 11 is a right side, fragmentary, exploded, perspective view of the system shown in FIG. 1, the system being shown with the needle removed therefrom.
Figure 12:
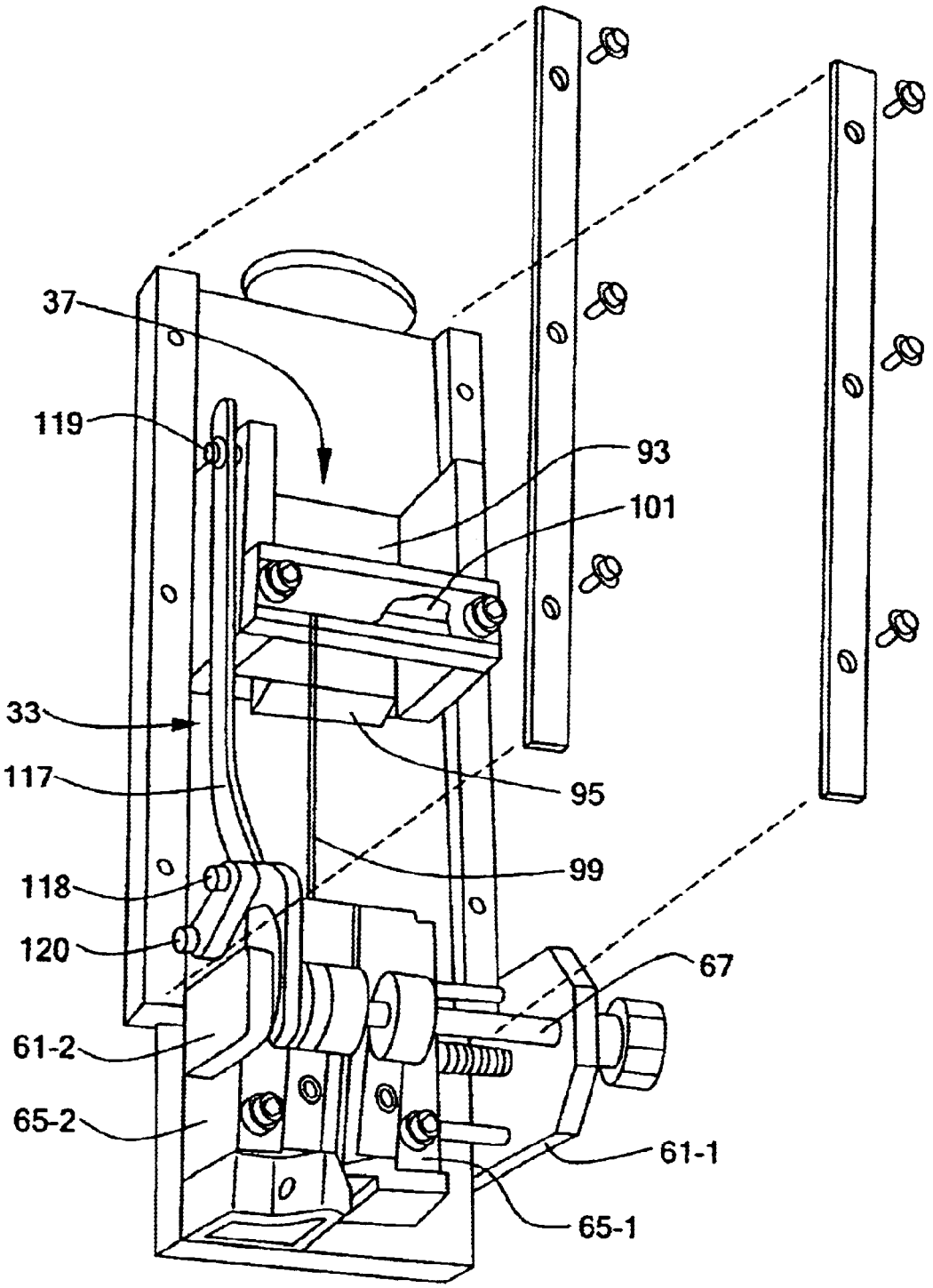
FIG. 12 is a perspective view of selected components of the system shown in FIG. 1.

As noted above, system 10 further comprises a feed mechanism 33 for continuously advancing fastener stock 11 therethrough. As shown in FIG. 11, feed mechanism 33 comprises a pair of spaced apart, sprocket feed wheels 105 which are fixedly mounted onto a shaft 107. Feed wheels 105 are adapted to engage the filaments 23 of fasteners 18 to advance the supply of fastener stock 11 through system 10. A feed knob 109 is fixedly mounted onto shaft 107 to allow for manual advancement of fastener stock 11 through system 10, which is highly desirable.

A ratchet wheel 111 is fixedly mounted onto shaft 107 and a pivotable feed pawl 113 is adapted to selectively engage ratchet wheel 111. As such, the pivoting of feed pawl 113 serves to rotate ratchet wheel 111 which, in turn, drives feed wheels 105, thereby disposing the lowermost fastener 18 in fastener stock 11 into position at the rear end of hollowed needle 31 for subsequent ejection.

Feed pawl 113 is, in turn, connected to a pivotable feed lever 115 and a movable feed link 117 by a bolt 118. As can be appreciated, as ejector rod slide 85 completes its upward stroke, a bolt 119 engages feed link 117 and pulls feed link 117 upwards. The upward displacement of feed link 117, in turn, causes feed pawl 113 to pivot about a pivot point 120 on feed lever 115, thereby advancing fastener stock 11 through system 10.

It should be noted that the construction and functionality of feed mechanism 33 does not serve as a principal feature of the present invention. As a result, it is to be understood that feed mechanism 103 could be of the type disclosed in U.S. Pat. No. 5,433,366 to Charles L. Deschenes et al. without departing from the spirit of the present invention.

Severing Mechanism 35 for System 10

Figure 9:
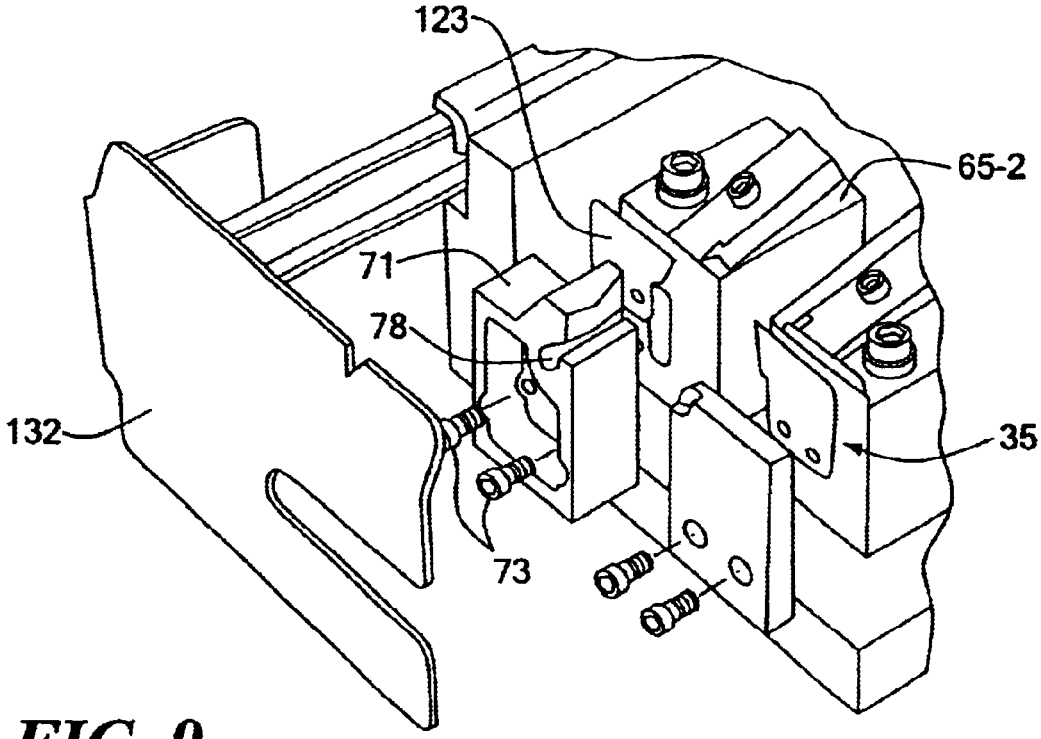
FIG. 9 is a fragmentary, exploded perspective view of the system shown in FIG. 1, the system being shown with the needle removed therefrom.
Figure 10:
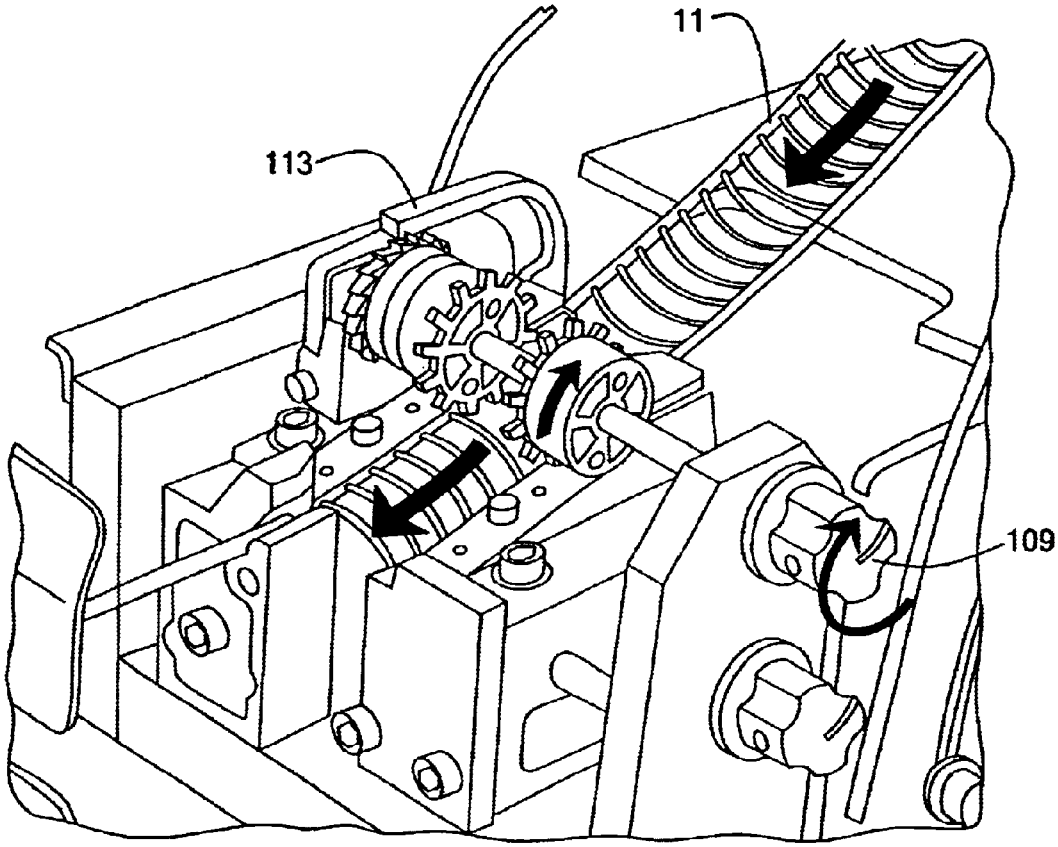
FIG. 10 is a right side, fragmentary, perspective view of the system shown in FIG. 1, the system being shown with a supply of continuously connected ladder stock fed therein.

As noted above, system 10 additionally comprises a severing mechanism 35 for severing the lowermost fastener 18 from fastener stock 11 prior to ejection through needle 31. As shown in FIG. 9, severing mechanism 35 comprises a knife blade 123 which is pivotably disposed between needle block 65-2 and needle holder 71.

Severing mechanism 35 also comprises a knife lever 125 connected to knife blade 123, a spring-biased knife pivot 127 connected to knife lever 125 and a knife roller 129 connected to knife pivot 127. As can be appreciated, knife roller 129 is biased downward so as to continuously contact frame 59. Accordingly, as ejector rod slide 85 begins its downward stroke, knife roller 129 travels up and over ramp 95. As knife roller 129 travels up and over ramp 95, knife roller 129 pivots knife pivot 127 which, in turn, pulls knife lever 125. Resultingly, the pulling of knife lever 125 inwardly pivots knife blade 123, thereby severing the lowermost fastener 18 from fastener stock 11. It should be noted that spring-biased knife pivot 127 is designed only to pull knife lever 125 when ejector rod slide 85 begins its downward stroke and not when ejector rod slide 85 completes its upward stroke.

It should be noted that the construction and functionality of severing mechanism 35 does not serve as a principal feature of the present invention. As a result, it is to be understood that severing mechanism 35 could be of the type disclosed in U.S. Pat. No. 5,433,366 to Charles L. Deschenes et al. without departing from the spirit of the present invention.

Needle Guard Assembly 39 for System 10

System 10 further comprises needle guard assembly 39 mounted onto frame 29 for stiffening and selectively protecting hollowed needle 31, as will be described further in detail below. As can be appreciated, the particular construction and functionality of needle guard assembly 39 serves as a principal feature of the present invention.

Figure 3:
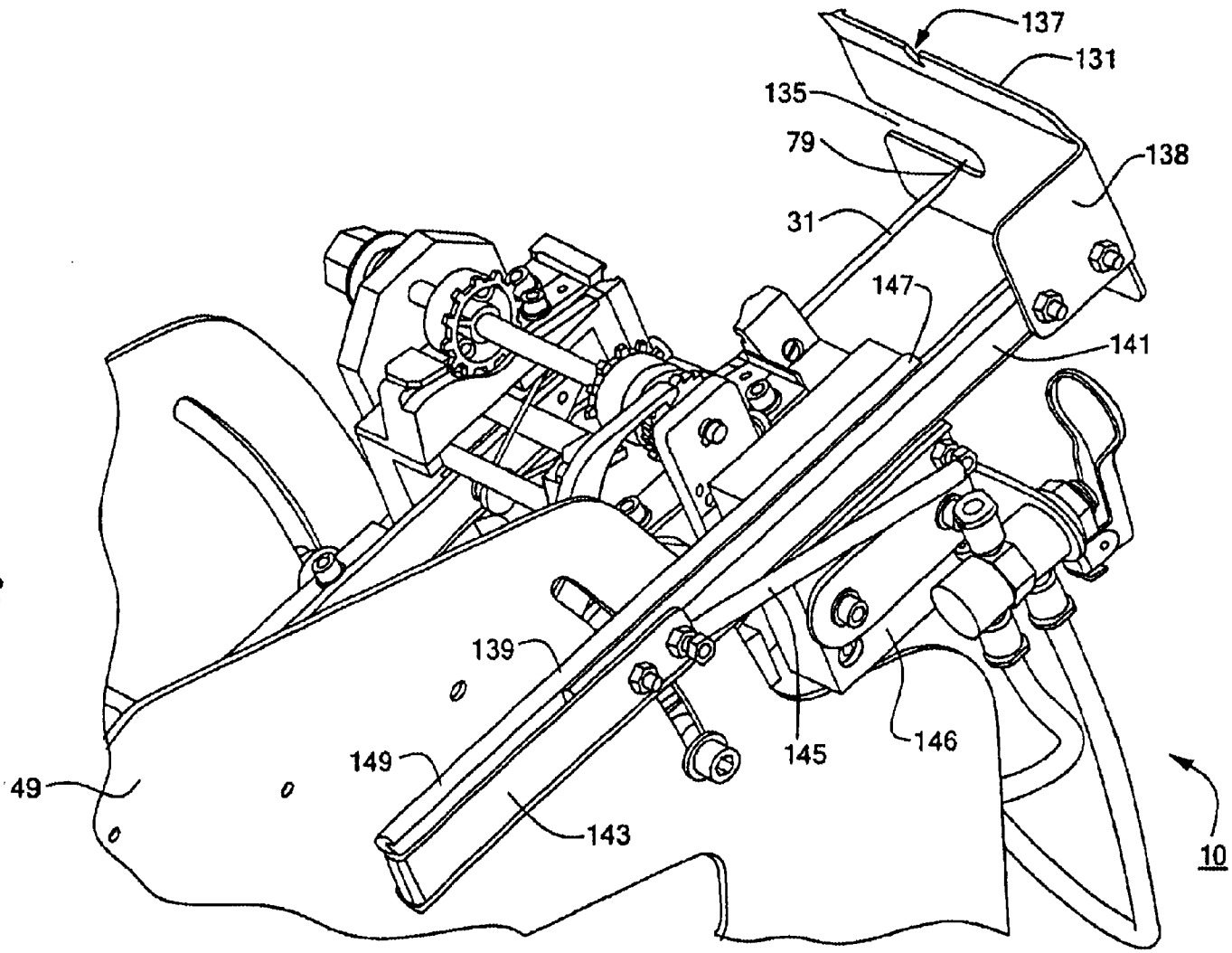
FIG. 3 is a left side, fragmentary, perspective view of the system shown in FIG. 1, the system shown with the guide plate disposed in its protected position.
Figure 4:
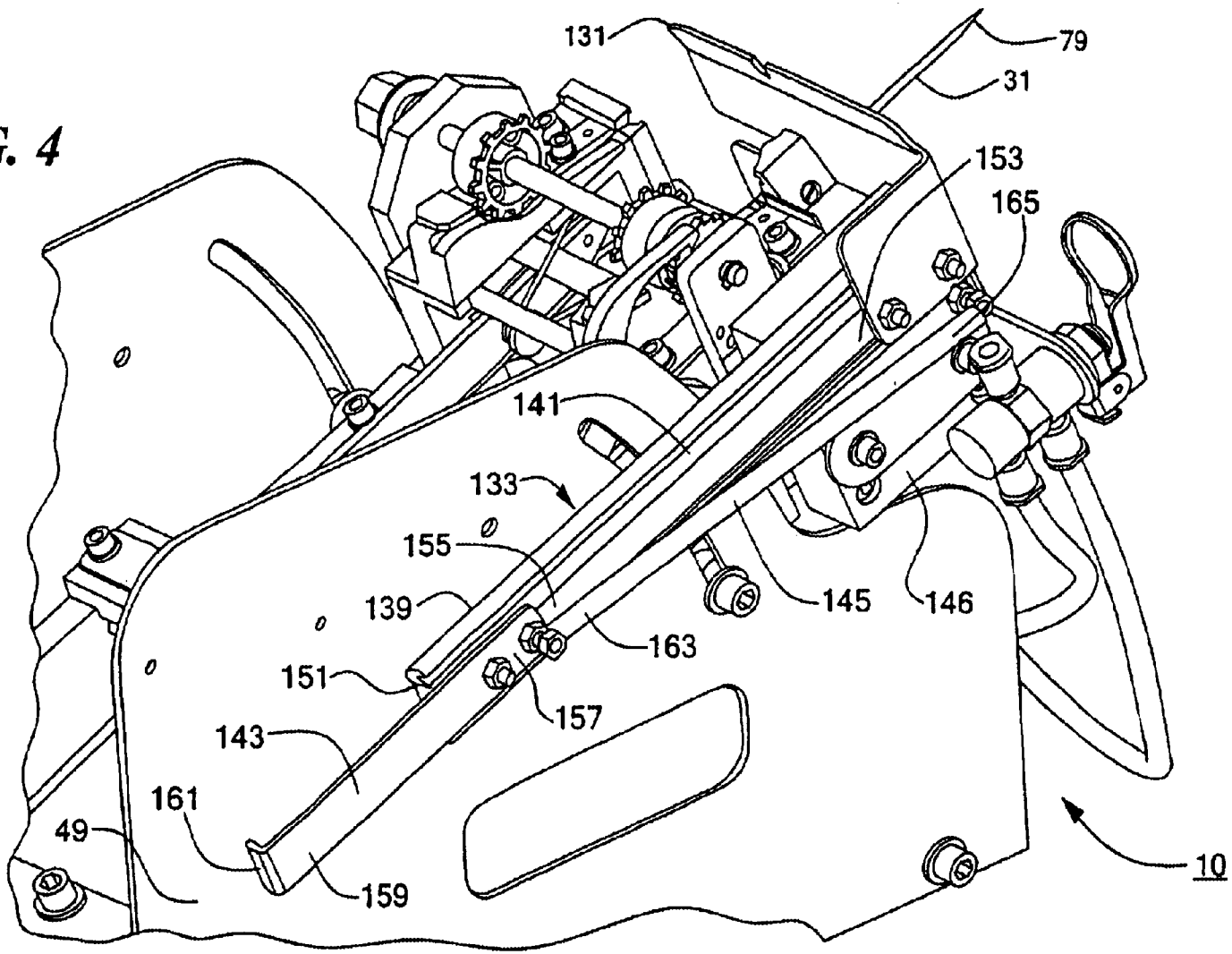
FIG. 4 is a left side, fragmentary, perspective view of the system shown in FIG. 1, the system shown with the guide plate disposed in its fully retracted position.

As shown in FIGS. 3 and 4, needle guard assembly 39 comprises a guide plate 131 disposed over second end 79 of needle 31 and a bracket assembly 133 affixed to guide plate 131. As will be described further below, bracket assembly 133 is slidably mounted onto second side panel 49 so as to enable guide plate 131 to be slidably disposed between a protected position, as shown in FIG. 3, in which second end 79 of needle 31 is positioned behind front surface 132 of guide plate 131 and fully retracted position, as shown in FIG. 4, in which second end 79 of needle 31 is positioned in front of front surface 132 of guide plate 131.

Guide plate 131 is constructed of a rigid and durable metal plate which is generally rectangular in shape. Guide plate 131 comprises a flat front surface 132 and a lateral slot 135. It should be noted that lateral slot 135 is sized and shaped to enable second end 79 of needle 31 to selectively project therethrough. Specifically, with guide plate 131 disposed in its fully retracted position, second end 79 of needle 31 projects through lateral slot 135 and, with guide plate 131 disposed in its protected position, second end 79 of needle 31 is disposed behind front surface 132 of plate 131.

Guide plate 131 also comprises an alignment indicator 137 for identifying the lateral position of second end 79 of needle 31 behind guide plate 131 when guide plate 131 is disposed in its protected position. Alignment indicator 137 is shown as being in the form of a V-shaped notch. However, it is to be understood that alignment indicator 137 is not limited to a V-shaped notch. Rather, alignment indicator 137 represents any means for identifying the lateral position of second end 79 of needle 31 behind guide plate 131, such as a line or arrow etched into front surface 132 of guide plate 131, without departing from the spirit of the present invention.

Guide plate 131 further comprises a rectangular tab 138 which extends generally orthogonally from front surface 132.

Bracket assembly 133 comprises a bracket 139 fixedly mounted onto second side panel 49, a first arm 141 slidably mounted onto bracket 139, a second arm 143 mounted onto first arm 141, a compression spring 145 connected to second arm 143 and a block 146 fixedly mounted onto support plate 61-2.

Bracket 139 is generally U-shaped in lateral construction and is fixedly mounted onto second side panel 49 proximate needle 31 by any conventional means, such using one or more nuts and bolts. Bracket 139 comprises a first end 147 and a second end 149. A stop 151 is formed onto bracket 139 at second end 149.

First arm 141 is an elongated rectangular member and comprises a first end 153 affixed onto tab 138 by any conventional means, such as using one or more nuts and bolts, and a second end 155. First arm 141 is preferably slidably mounted onto bracket 139 using one or more ball bearings.

Second arm 143 is similarly an elongated rectangular member and comprises a first end 157 affixed onto second end 155 of first arm 141 by any conventional means, such as using one or more nuts and bolts, and a second end 159. A stop 161 is formed onto second arm 143 at second end 159. It should be noted that stop 161 is sized and shaped to abut against stop 151 on bracket 139 when guide plate 131 is in its protected position so as to limit the forward displacement of guide plate 131 relative to needle 31.

Compression spring 145 is conventional in construction and includes a first end 163 affixed onto first end 157 of second arm 143 and a second end 165 affixed onto block 146. As such, compression spring 145 serves to resiliently urge second arm 143 forward, thereby disposing guide plate 131 into its protected position.

As will be described further in detail below, needle guard assembly 39 functions within system 10 in the following manner. In the absence of any application of force upon front surface 132 of guide plate 131, compression spring 145 resiliently urges guide plate 131 into its protective position so that second end 79 of needle 31 is positioned behind front surface 132 of guide plate 131, as shown in FIG. 3.

Figure 5:
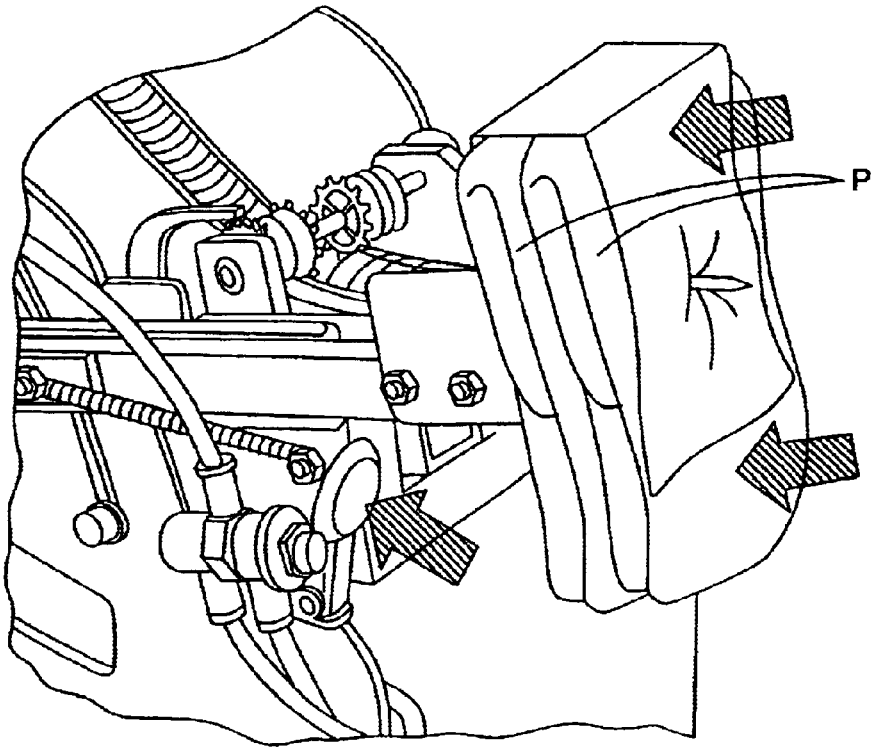
FIG. 5 is a left side, fragmentary, perspective view of the system shown in FIG. 1, the system shown securing together a pair of products.

In order for needle 31 to penetrate through two or more products P to be coupled together, the operator is required to position the products P against front surface 132 of guide plate 131. With the products P positioned against front surface 132, the operator is required to urge guide plate 131 inward from its protected position to its fully retracted position, as shown in FIG. 5. As such, the rearward displacement of guide plate 131 exposes second end 79 of needle 31 such that second end 79 penetrates through products P. With needle 31 penetrated through products P, the operator can depress actuation lever 97 to dispense fasteners 18, thereby coupling products P together.

As can be appreciated, needle guard assembly 39 provides four principal advantages.

As a first advantage, needle guard assembly 39 serves as a safety device. Specifically, needle guard assembly 39 prevents the operator inadvertently contacting the sharpened point of hollowed needle 31 when system 10 is not in use, which is highly desirable.

As a second advantage, needle guard assembly 39 serves as a stiffening, or support, device for needle 31. Specifically, needle guard assembly 39 supports needle 31 as needle 31 is inserted through products P to be coupled, thereby preventing needle 31 from bending and/or breaking, which highly desirable.

As a third advantage, needle guard assembly 39 serves as an alignment device for identifying the lateral position of second end 79 of needle 31 behind guide plate 131 when guide plate 131 is disposed in its protected position. Specifically, with products P to be coupled together disposed against front surface 132 of guide plate 131, alignment indicator 137 enables the operator to determine the lateral position of needle 31 behind products P and guide plate 131, which is highly desirable.

As a fourth advantage, needle guard assembly 39 serves as an anvil, or support, for products P during use. Specifically, needle guard assembly 39 serves as a movable support surface for products P as products P are urged against second end 79 of needle 31, which is highly desirable.

Reel Holder 41 for System 10

Reel holder 41 is affixed onto frame 29 and serves to support reel 27 of fastener stock 11.

As shown in FIG. 1, reel holder 41 is in the form of a thin metal post and comprises a first end 167 and a second end 169.

First end 167 of reel holder 41 is sized and shaped to extend horizontally through a central opening 28 formed in reel 27, thereby enabling reel holder 41 to support reel 27 of fastener stock 11. A pair of posts 168 are fixedly mounted onto first end 167 of reel holder 41 on opposite sides of reel 27 so as to secure reel 27 onto first end 167 of reel holder 41 but enabling reel 27 to rotate on reel holder 41 without interference.

Second end 169 is fixedly mounted onto first side panel 47 by a pair of screws 170.

Eye Shield Assembly 43 for System 10

Eye shield assembly 43 is affixed onto frame 29 and serves to protect the eyes of the operator during use of system 10.

Eye shield assembly 43 comprises a first linkage 171 mounted onto frame 29, a second linkage 173 mounted onto first linkage 171, a support bar 175 mounted onto second linkage 173 and an eye shield 177 mounted onto support bar 175.

First linkage 171 is an elongated rectangular member and comprises a first end 179 pivotally mounted onto first side panel 47 by a pin 180 and a second end 181.

Second linkage 173 is an elongated rectangular member and comprises a first end 183 pivotally mounted onto second end 181 of first linkage 171 and a second end 185.

Support bar 175 is a generally L-shaped member which includes a first end 187 pivotally mounted onto second end 185 of second linkage 173 and a second end 189.

Eye shield 177 is in the form of a rectangular plate of transparent material, such as plexiglass, and is fixedly secured onto support bar 175. Accordingly, the position of eye shield 177 can be adjusted according to the particular need of the operator, which is highly desirable.

Operation of System 10

Figure 6:
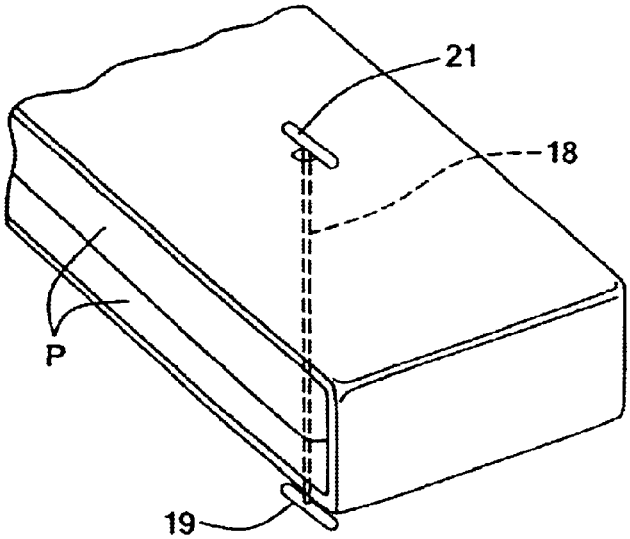
FIG. 6 is a fragmentary, perspective view of the pair of products shown in FIG. 5 being secured together by a plastic fastener.

In use, system 10 is preferably mounted onto a flat work surface, such as a table, and can be used to affix together two or more products P using one or more plastic fasteners 18 from fastener stock 11 in the following manner. Using alignment indicator 137 as a guide, the operator positions products P against front surface 132 of guide plate 131. With products P properly aligned against front surface 132, the operator urges products P against guide plate 131 so as to dispose guide plate 131 from its protected position to its fully retracted position. As guide plate 131 is disposed into its fully retracted position, second end 79 of needle 31 extends through slot 135 and into and through products P. Once second end 79 of needle 31 has penetrated entirely through products P, the operator depresses actuation lever 97 which, in turn, causes a single fastener 18 to eject out through needle 31. The ejection of single fastener 18 disposes end bars 19 and 21 on opposite sides of products P, thereby coupling products P together, as shown in FIG. 6.

The process can be repeated as necessary, wherein a subsequent depression of actuation lever 97 ejects another fastener 18 out through needle 31. Accordingly, because a continuous supply of fastener stock 11 can be loaded into system 10, it is to be understood that system 10 can be used to continuously apply fasteners 18 without reloading.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A system for dispensing a plastic fastener from a reel of fastener stock to couple together two or more objects, said system comprising:

(a) a frame, (b) a hollowed needle having a sharpened tip, said hollowed needle being held fixedly in place, (c) a feed mechanism for advancing the fastener stock into said hollowed needle, (d) a severing mechanism for severing the fastener to be dispensed through said hollowed needle from the fastener stock, (e) an ejection mechanism for ejecting the severed fastener through said hollowed needle, and (f) a needle guard assembly for protecting said hollowed needle, said needle guard assembly comprising, (i) a guide plate having a front surface, (ii) a bracket assembly for displacing said guide plate between a first position in which the tip of said needle is positioned behind the front surface of said guide plate and a second position in which the tip of said needle is positioned in front of the front surface of said guide plate, said bracket assembly resiliently displacing said guide plate to its first position in the absence of an outside force on said guide plate, said bracket assembly comprising, (A) a bracket fixedly mounted onto said frame, (B) a first arm slidably mounted onto said bracket, said first arm being coupled to said guide plate, (C) a second arm coupled to said first arm, and (D) a spring for resiliently displacing said guide plate to its first position in the absence of an outside force on said guide plate.

2. The system as claimed in claim 1 wherein said bracket has a stop and said second arm has a stop, the stop on said second arm being sized and shaped to abut against the stop on said bracket when said guide plate is in its first position so as to limit further forward displacement of said guide plate relative to said needle.

3. The system as claimed in claim 2 wherein said guide plate includes an opening which is sized and shaped to enable said hollowed needle to selectively project therethrough.

4. The system as claimed in claim 3 wherein, with said guide plate disposed in its second position, said hollowed needle extends through the opening formed in said guide plate.

5. The system as claimed in claim 4 wherein the opening in said guide plate is in the form of an elongated horizontal slot.

6. The system as claimed in claim 4 wherein an alignment indicator is formed into said guide plate for identifying the lateral position of the sharpened tip of said hollowed needle relative to said guide plate, said alignment indicator being spaced apart from the opening formed in said guide plate.

7. A system for dispensing a plastic fastener from a reel of fastener stock to couple together two or more objects, said system comprising:

(a) a frame, (b) a hollowed needle having a sharpened tip, (c) a feed mechanism for advancing the fastener stock into said hollowed needle, (d) a severing mechanism for severing the fastener to be dispensed through said hollowed needle from the fastener stock, (e) an ejection mechanism for ejecting the severed fastener through said hollowed needle, and (f) a needle guard assembly mounted onto said frame over said hollowed needle, said needle guard assembly comprising, (i) a guide plate having a front surface, and (ii) a bracket assembly affixed to said guide plate, said bracket assembly being slidably mounted onto said frame so as to enable said guide plate to be slidably disposed between a protected position in which the tip of said needle is positioned behind the front surface of said guide plate and a fully retracted position in which the tip of said needle is positioned in front of the front surface of said guide plate, said bracket assembly comprising, (A) a bracket fixedly mounted onto said frame, said bracket having a rear stop, (B) a first arm slidably mounted onto said bracket, said first arm comprising a first end affixed to said guide plate and a second end, (C) a second arm having a first end affixed to the second end of said first arm and a second end having a stop, wherein the stop formed on the second end of said second arm is sized and shaped to abut against the rear stop formed on said bracket when said bracket assembly is in its protected position so as to limit forward displacement of said guide plate relative to said needle, and (D) a compression spring for resiliently urging said second arm forward, said compression spring including a first end affixed onto the first end of said second arm and a second end affixed onto said frame.

8. A system for dispensing a plastic fastener from a reel of fastener stock to couple together two or more objects, said system comprising:

(a) a frame, (b) a hollowed needle having a sharpened tip, (c) a feed mechanism for advancing the fastener stock into said hollowed needle, (d) a severing mechanism for severing the fastener to be dispensed through said hollowed needle from the fastener stock, (e) an ejection mechanism for ejecting the severed fastener through said hollowed needle, and (f) a needle guard assembly mounted onto said frame over said hollowed needle, said needle guard assembly comprising, (i) a guide plate having a front surface, and (ii) a bracket assembly affixed to said guide plate, said bracket assembly enabling said guide plate to be slidably disposed between a protected position in which the tip of said needle is positioned behind the front surface of said guide plate and a fully retracted position in which the tip of said needle is positioned in front of the front surface of said guide plate, said bracket assembly comprising, (A) a bracket fixedly mounted onto said frame, said bracket having a rear stop, (B) a first arm slidably mounted onto said bracket, said first arm comprising a first end affixed to said guide plate and a second end, (C) a second arm having a first end affixed to the second end of said first arm and a second end having a stop, wherein the stop formed on the second end of said second arm is sized and shaped to abut against the rear stop formed on said bracket when said bracket assembly is in its protected position so as to limit forward displacement of said guide plate relative to said needle, and (D) a compression spring for resiliently urging said second arm forward, said compression spring including a first end affixed onto the first end of said second arm and a second end affixed onto said frame.

* * * * *